US006197235B1

(12) United States Patent
Miller et al.

(10) Patent No.: US 6,197,235 B1
(45) Date of Patent: Mar. 6, 2001

(54) METHOD OF MANUFACTURE FOR TEXTURED SURFACE PANELS AND PANEL PRODUCTS MADE THEREFROM

(75) Inventors: David Paul Miller, Lindenhurst; Matthew Huss, Lisle, both of IL (US)

(73) Assignee: United States Gypsum Company, Chicago, IL (US)

( * ) Notice: Subject to any disclaimer, the term of this patent is extended or adjusted under 35 U.S.C. 154(b) by 0 days.

(21) Appl. No.: 09/246,453

(22) Filed: Feb. 9, 1999

(51) Int. Cl.[7] ..... B28B 3/00

(52) U.S. Cl. ..... 264/86; 156/45; 264/87; 264/122; 264/128; 264/119; 264/284; 264/293; 264/333

(58) Field of Search ..... 264/86, 87, 118, 264/119, 120, 122, 128, 333, 284, 293; 156/39, 45, 42; 106/778, 781, 783

(56) References Cited

U.S. PATENT DOCUMENTS 3,838,001 * 9/1974 Greiner et al. ..... 425/84
4,784,816 * 11/1988 Sattler ..... 264/333
4,966,739 * 10/1990 Stipek et al. ..... 156/45
5,116,555 * 5/1992 Thole et al. ..... 264/333
5,198,052 * 3/1993 Ali ..... 156/45
5,320,677 * 6/1994 Baig .
5,531,946 * 7/1996 Bold ..... 156/45
5,846,317 * 12/1998 Sattler et al. ..... 156/39

* cited by examiner

*Primary Examiner*—Mathieu D. Vargot
(74) *Attorney, Agent, or Firm*—Lee, Mann, Smith, McWilliams, Sweeney & Ohlson; John M. Lorenzen; David F. Janci

(57) ABSTRACT

An improved method for texturing gypsum fiber panels and producing surface textured panels, edge tapers, and deeper patterned wainscot-type panels, involving the use of a flexible die with a textured surface. The die is pressed onto the panel in its slurry state just after the onset of an exothermic rehydration reaction. Partial hydration and setting occur during pressing by the die to form a textured mat. The mat is removed from contact with the die at a point along the rehydration temperature curve about at or less than one-half of the rise to the greatest rehydration temperature.

19 Claims, 7 Drawing Sheets

METHOD OF MANUFACTURE FOR TEXTURED SURFACE PANELS AND PANEL PRODUCTS MADE THEREFROM

BACKGROUND OF THE INVENTION

The present invention relates generally to the ability to impart surface textures on composite materials for use in the construction industry. More particularly, the present invention relates to the use of lightweight, flexible dies to impart surface texture on composite materials when the composite materials are still in a semi-slurry state.

The United States Gypsum Company's gypsum fiberboard process, as shown and described in U.S. Pat. No. 5,320,677, and herein incorporated by reference in its entirety, describes a composite product and a process for producing a composite material in which a dilute slurry of gypsum particles and cellulosic fibers are heated under pressure to convert the gypsum, i.e. Calcium sulfate in the stable dihydrate state ($CaSO_4 \cdot 2H_2O$), to calcium sulfate alpha hemihydrate having acicular crystals. The cellulosic fibers have pores or voids on the surface and the alpha hemihydrate crystals form within, on and around the voids and pores of the cellulosic fibers. The heated slurry is then dewatered to form a mat, preferably using equipment similar to paper making equipment, and the slurry cools enough to begin rehydrating the hemihydrate to gypsum, whereupon the mat is pressed into a board of the desired configuration. The pressed mat undergoes an exothermic reaction and rehydrates to gypsum to form a dimensionally stable, strong and useful building board. The board is thereafter trimmed and dried.

One of the many advantages of the process disclosed in the '677 patent is that a surface texture can be imparted on the resulting gypsum panel as the panel is being formed. Two examples of boards of this type are textured panels for manufactured housing applications and surface relief panels for a variety of markets.

The challenge in surface texturing gypsum fiberboard during in-line processing is the timing of the impression made on the slurry or wet mat. As the rehydration begins and solidification of the mass starts to occur, an exothermic reaction takes place. Firstly after calcination there is a cooling of the mat as the slurry is dewatered, such as by vacuum extraction and a primary press arranged along the moving conveyor belt or screen. The dewatering primary press is used as a first press to eliminate up to approximately 90% of the free water remaining after vacuum extraction. Before rehydration, it is important to eliminate usually about 80–90% of free water while bringing the temperature of the filter cake down. Dewatering processes contribute significantly to lowering the filter cake temperature. Extracting free water is necessary when seeking to texture and wet press the filter cake into a desired product shape. Alternatively, the filter cake could be immediately dried and then cooled to a stable but rehydratable hemihydrate for later use. It is therefore also desirable to remove as much of the free water that is not required in the composite mass for rehydration before the temperature drops to the rehydration temperature.

Upon reaching the rehydration temperature, which may require additional cooling, an exothermic reaction takes place. The exothermic reaction results in a hydration curve which is plotted as temperature over time, or distance along the conveyor. As the rehydratable calcium sulfate hemihydrate and cellulosic fibers in a slurry form leave the head box, the hemihydrate crystals will have a temperature generally in the range of about 180° F. to about 210° F. Thereafter, the slurry is spread across the conveyor and the action of vacuum pumps begins removal of the free water and the temperature drops significantly. The rehydration temperature on the conveyor can vary depending on the additives and accelerators used, but is generally in the range from about 60° F. to about 120° F. This would plot as the low or starting point on the hydration, or so-called temperature trace, curve. At this point, the exothermic reaction ensues and heat is released. The temperature plot will show an increasing curve until a substantially constant slope (linear) plot of increasing temperature over time, or distance, is reached. The exothermic reaction will then taper resulting in a graphic change from an upward linear slope to a curved plot that reaches a peak temperature, signaling a decrease in hydration rate. Thereafter, the curve slopes downwardly as the reaction winds down to reach 100% hydration. Ultimately, the board may be dried to eliminate any excess water.

The critical key for imparting texture is finding where on the temperature curve between the inception of hydration to its termination should texturing occur so that a) the texturing does not end too soon for the setting composite to hold the relief, b) the forming acicular gypsum crystal structures are not destroyed, and c) the impression is not imparted so late that the surface texture is broken by having been too firmly set to receive texture.

The usual method of choice for imparting textures on wide panels is by using a roll to texture a moldable surface, such as is done with wet felted ceiling tile. However, fabrication of such rolls typically has long lead times and high costs. Another option is to make flat sheets and then glue them on to the roll. Unfortunately, for both methods, fabricated rolls then have little opportunity to change the texturing pattern. Roll processes heretofore have not proved highly successful.

A third roll method is the fabrication of rubber sleeves over KEVLAR brand para-aramid or nickel, which may then be slid on or off of a mandrel, generally using compressed air. This method allows texture changes using less expensive sleeves over a common mandrel, yet still has long lead times for initial fabrication.

A non-roll option, which is commonly used for embossed hardboard and some cement board products, involves machining a steel platen, laying it against a surface and applying sufficient pressure and or heat in a platen press to impart the texture to a panel surface. These imparted surface are generally very high quality. The steel platens have the added advantage of making it easy to change textured patterns, as long as a different platen pattern is in stock. However, this method requires difficult and unwieldy equipment that is associated with the handling of steel platens, especially with larger size panels. In addition, such large steel platen dies tend to be expensive.

Deep patterns, such as wood grained panels or wainscot panels, may be made in at least one of four ways. Wood molding may be cut and attached to paneled products. The disadvantage to this method is cost and the time associated with the finishing of molded corners and edges as well as maintaining uniformity of panels. Uniformity may be increased by using a roll to impart the texture to a moldable surface, such as is done with wet felted ceiling tile. However, fabrication of such rolls typically has long lead times and high costs. Deeper features, such as the molding of wainscot panels, require more machining with higher cost and even longer lead times. Such rolls then have little opportunity to change the embossing pattern. A third option involves machining a steel platen, laying it against a surface and applying sufficient pressure and or heat to impart the texture to a panel surface as described above. A fourth method is machining the profile or relief into the surface of the panel, which gives a rougher surface and generates substantial dust that must be collected, handled and disposed of, or recycled.

SUMMARY OF THE INVENTION

The present invention relates generally to producing gypsum fiberboard panels with surface texture. More particularly, the present invention relates to the use of flexible, lightweight dies to impart surface texture to gypsum fiberboard panels while the panels are in a semi-slurry state.

This invention involves a method for imparting texture to a gypsum fiberboard shortly after the inception of the rehydration and melding the hydration curve with processing points along the production line. The invention provides for a dewatering by vacuum suction of the slurry leaving the head box and then passing the slurry to a first press, just after the rehydration temperature has been reached, where further dewatering occurs removing approximately 80–90% of the remaining free water. At this point a small percent of rehydration of the hemihydrate has begun and a wet fiber mat exits the first or primary press. At this juncture the temperature of the slurry has diminished and will rise as rehydration occurs. A texturing die, as will be defined herein, is then provided to be adapted for running on a second press. The location along the processing line for beginning texturing is commensurate with the temperature rate increase from the low point on the hydration curve, so that the texturing die meets the mat substantially at a point where the mat is pliable and partially rehydrated. The texturing die is then placed into pressure contact against the mat as hydration accelerates. Earlier in the process of forming the slurry, acicular crystalline structures in the gypsum and cellulosic fibers have intermingled and formed a matrix. This matrix is precompressed in the first press and re-compressed by the texturing die. The crystalline and fiber formation expands upwardly against the die due to hydration, leaving embossments and other surface relief as desired by the manufacturer. The hydrating gypsum with the fiber expands in the secondary press to a certain pre-set press nip thickness. Breakage of the forming and rehydrating crystals is minimized.

It has been found that the start point and duration of the texturing in relation to the hydration curve is best achieved starting slightly past the low temperature point at the inception of rehydration and continuing to a temperature level equal to about 25–60% of the ultimate temperature rise, so that before leaving the texturing die the hydrating mat experiences up to about 25–60% of the maximum temperature level occurring at the zenith of the curve.

The disclosed method for producing both large texture surface panels, smaller deeper patterned wainscot panels , spatter knock-down relief, edge tapers, and other kinds of textures, involves the use of a flexible urethane die with a textured surface. The urethane die is initially made from a master surface having the desired texture. Once the urethane is applied to the master surface, it is allowed to cure and then removed. The resulting compound is a flexible urethane die that has the master surface molded within.

This flexible urethane die is then applied to the composite material while the composite material is still in a semi-slurry state. Sufficient pressure is applied to the urethane die to impart its texture to the composite material while the composite material hardens. After a sufficient amount of time has passed, the urethane die is removed from the composite material, and the resulting product is a textured surface board that is cut into panel sizes.

DETAILED DESCRIPTION OF THE PREFERRED EMBODIMENT

Figure 1:
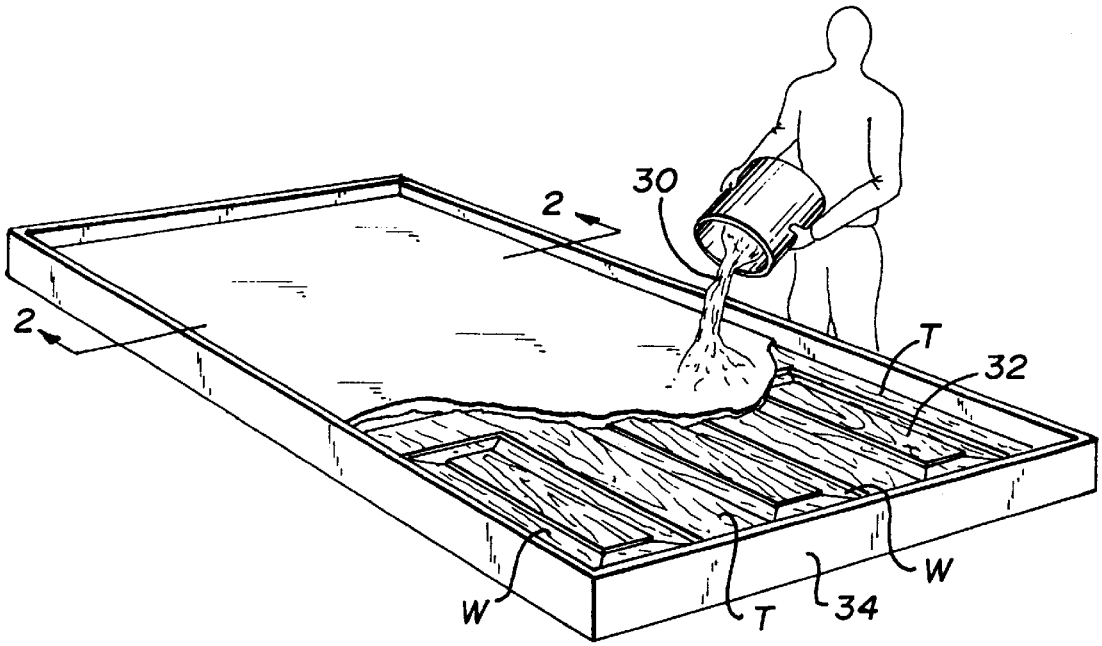
FIG. 1 is a perspective view of a worker pouring a urethane compound onto a master panel that is held within a dam having surface relief to which the urethane conforms upon curing.

The present invention is directed to a forming system for imparting texture to large surface gypsum fiberboard panels to form textured panels and surface relief panels, and in particular, the use of lightweight, flexible dies to impart texture on surface panels when the panels are still in a semi-slurry state. The forming system, generally designated with the numeral 10 and best shown in FIG. 5, includes a head box 12, vacuum boxes 14, a wet (primary) press 16 for 1) nipping the filter cake mat to a desired thickness and 2) removing about 80–90% of remaining water, and a secondary press 18 for 1) imparting a surface texture that is the negative image of the belt surface or texturing die used, 2) achieving a final calibrated board thickness as the setting composite expands against the press belt or die, and 3) aiding in improving flexural strength as the crystalline composite expands during rehydration against the press belt or die.

The head box 12 is used to uniformly disperse the calcined slurry, having at least about 70% liquid by weight, across the width of the forming table or conveyor, where vacuum boxes 14 are used to dewater the slurry into a mat of generally 28–41% moisture content (wet basis) (40–70% moisture content on a dry basis). The wet (primary) press 16, which consists of alternating nips of suction and plain rolls, and a porous belt, further dewaters and consolidates the mat under the combined effect of vacuum and pressure to a moisture content (wet basis) of 23–35% (30–55% on a dry basis). The similarities to conventional forming lines known in the wood fiber board-making industry, allows their easy conversion. The spacing between the first and secondary presses—whether measured by time or distance—is tied to the hydration curve. Only slight hydration (about 5–10%) occurs in the primary press 16. The secondary press 18 is used for medium to higher density products and imparts a surface texture (or smoothness) depending on the belt surface or die used. This press 18 also decreases thickness variation by setting it at a fixed-gap nip slightly less than the desired end result board thickness. The gypsum expansion against such a fixed-gap surface also improves ultimate bending strength. The lightweight, flexible die 20 of the present invention is to be used in conjunction with the secondary press 18 of the forming system 10 to impart selective textures to the surface of large panels made from composite material. Expansion of the crystal formation with the fibrous particles gripped therein forces the setting mat against the texturing die 20 as the rehydration rate increases to reach a temperature level, being a certain percentage of the difference (AT) between the rehydration temperature and the highest temperature on the rehydration curve, at which point the mat exits the press 18.

Manufacture of Flexible Die for Textured Panels

The inventive method of using lightweight flexible dies is particularly useful with a continuous process of setting material, such as gypsum fiberboard. The preferred material is a urethane die that can be easily hand fed through a continuous press having sufficient pressure to compress or deform fine textures into the mat just after the point when setting begins. The mat is then removed after a certain amount of temperature rise and setting have occurred. There is a spring back of the composite mat on the conveyor, which is controllable to give more accuracy and control of the texture formation. The manufacture of urethane dies is generally known in the industry with respect to texturing and embossing impressionable media. In the present invention, there is the capability of inducing both a light surface texturing and also a deeper pattern, such as might be used to create deep wood grain or wainscot panels. In reference to FIG. 1, a worker is shown pouring a liquid urethane compound 30 onto a master panel 32 that is surrounded by a dam 34 to retain the pouring urethane 30.

It will be seen that the master panel 32 has deep wainscot portions W and woodgrain texturing portions T around and in the wainscot coating portion W. The master panel 32 can be made in this fashion or it can be made with only texturing T, wainscoting W, or both, as would be understood by those skilled in the art. In another embodiment, a popular spatter knock-down shallow texture can be obtained, which emulates the well-known manual technique of topping-off of texturing peaks by using a wide blade to leave smooth flat-tops surrounded by textured valleys, as will be discussed in regard to textures in FIGS. 4A and 4B. In yet another embodiment, boards may be made to have edge tapers, as at E in FIG. 3A, wherein the texturing is not grained or striated, but is simply marginal portions having lesser depth than the rest of the board. The mat shown in FIG. 3A would eventually be cut down the centerline to make two boards $B_1$ and $B_2$. Other well-known textures may also be achieved, e.g. a brush stipple effect, stucco-like look, and the like. As used in this specification and claims, the term "texture" broadly defines all of the types of deep or shallow surface relief that may be imparted to the setting mat, including, but not limited to, a simple localized change of thickness, such as edge tapering, to more complex regular patterns, i.e. wainscoting, checker board-look, grid-like configurations, repeating curves, arcs, and the like, and also including irregular random patterns, such as wood graining relief, spatter knock-down texturing, brush stipple effects, stucco-like surfaces, and the like.

Figure 2:
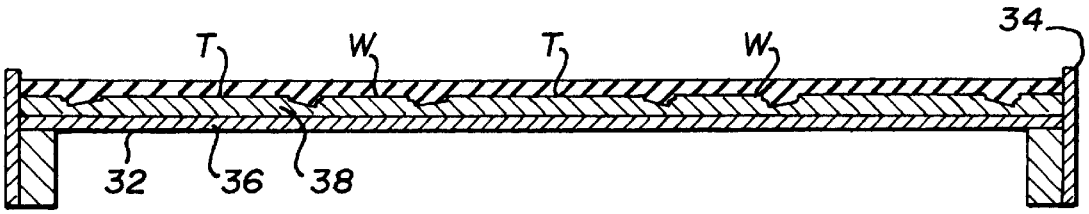
FIG. 2 is a cross-sectional view of the urethane covering the master panel of FIG. 1 showing in cross-hatched lines the filling of the master panel relief by the urethane.

With reference to the cross sectional view of FIG. 2, it will be seen that the master panel 32 has a gypsum or other rigid material base 36 and a hardened texturing compound 38 thereover for forming the relief pattern of wainscoting W and texturing T. The texturing compound 38 is first coated onto the gypsum panel 36. It may be impressed manually with tools, such as brushes or other pattern-forming implements, or can be impressed by placing against it a wood form having the inverse shape of wainscoting W, or other selected pattern, before the texturing compound 38 sets. In the disclosed embodiment the texturing compound 38 comprises TUFTEX brand texturing compound made by United States Gypsum Company.

Figure 3:
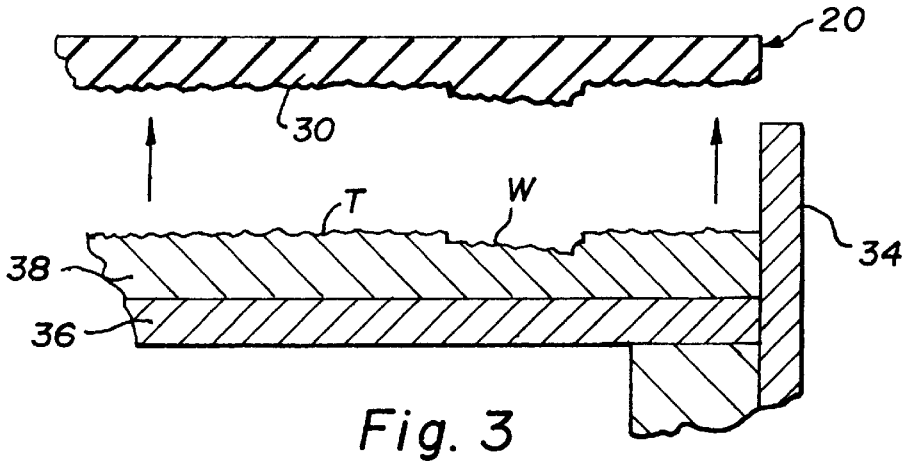
FIG. 3 shows the stripping away of the cured urethane layer having imparted thereon the texturing of the master panel.
Figure 3A:
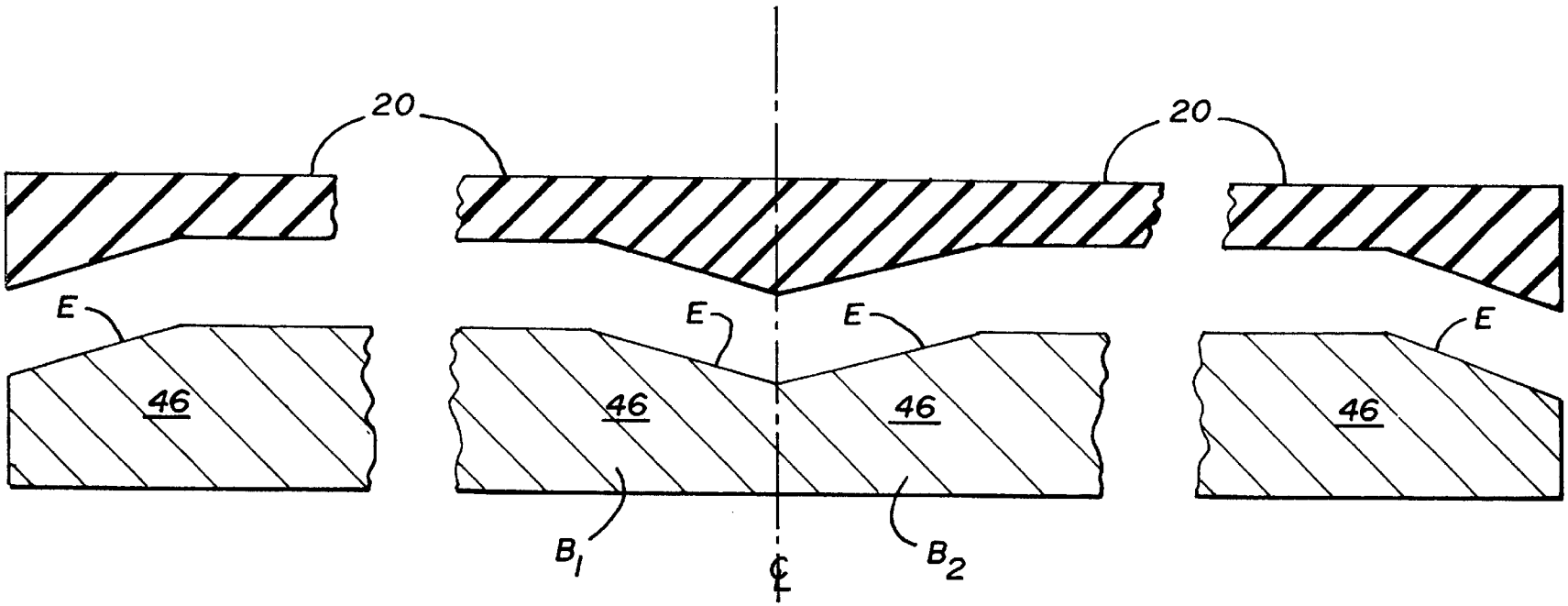
FIG. 3A shows in cross-section an edge taper-shaped die being removed from the mat leaving panel edge taper relief for the resulting panels.

When the urethane compound 30 has been poured into the dam 34, it is allowed a curing time, typically about 12 hours at a temperature in the range of about 170–185° F., as would be known to those skilled in the art. Of course, the urethane would cure if simply left at ambient temperatures, but would take much longer. Pre-applying a release compound over the texturing 38 permits the set urethane 30 to be peeled and lifted upwardly, as shown in FIGS. 3 and 4, and rolled up to form the completed texturing die 20.

Figure 4:
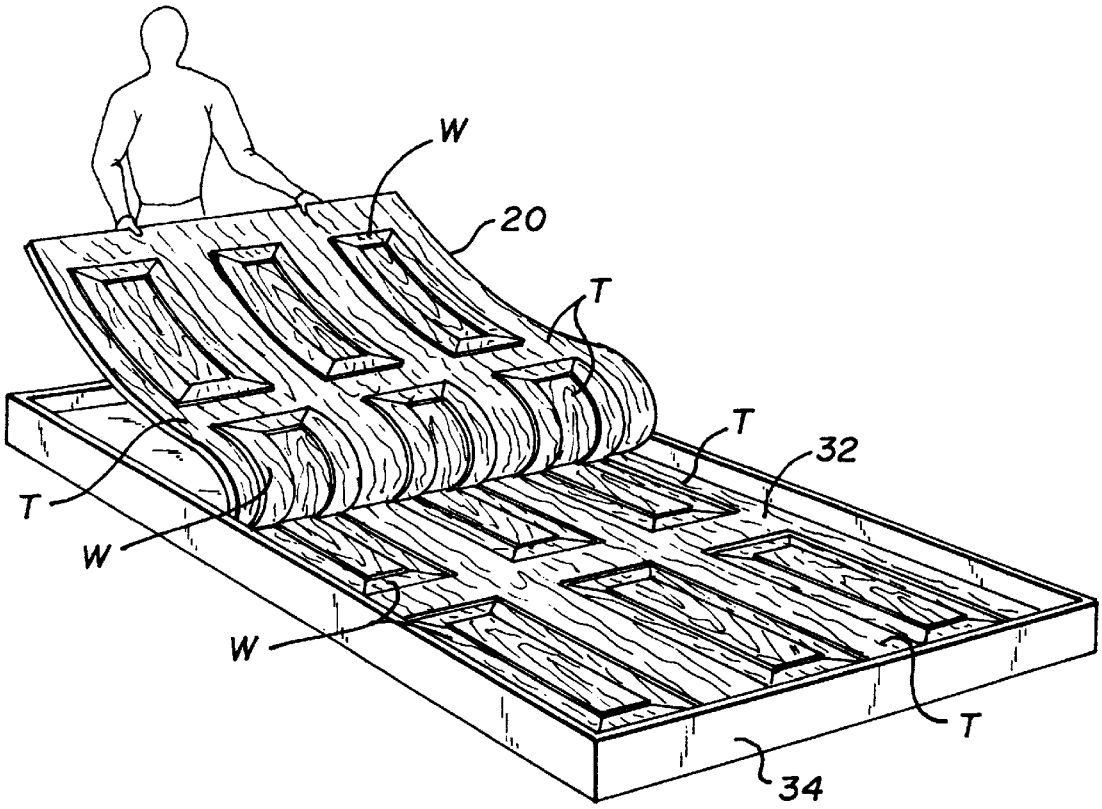
FIG. 4 shows a worker in a perspective view stripping the cured flexible urethane texture die from the mater panel having wainscot-shaped portions and woodgrain surface texturing portions thereby providing both deep texturing and surface texturing portions.
Figure 5:
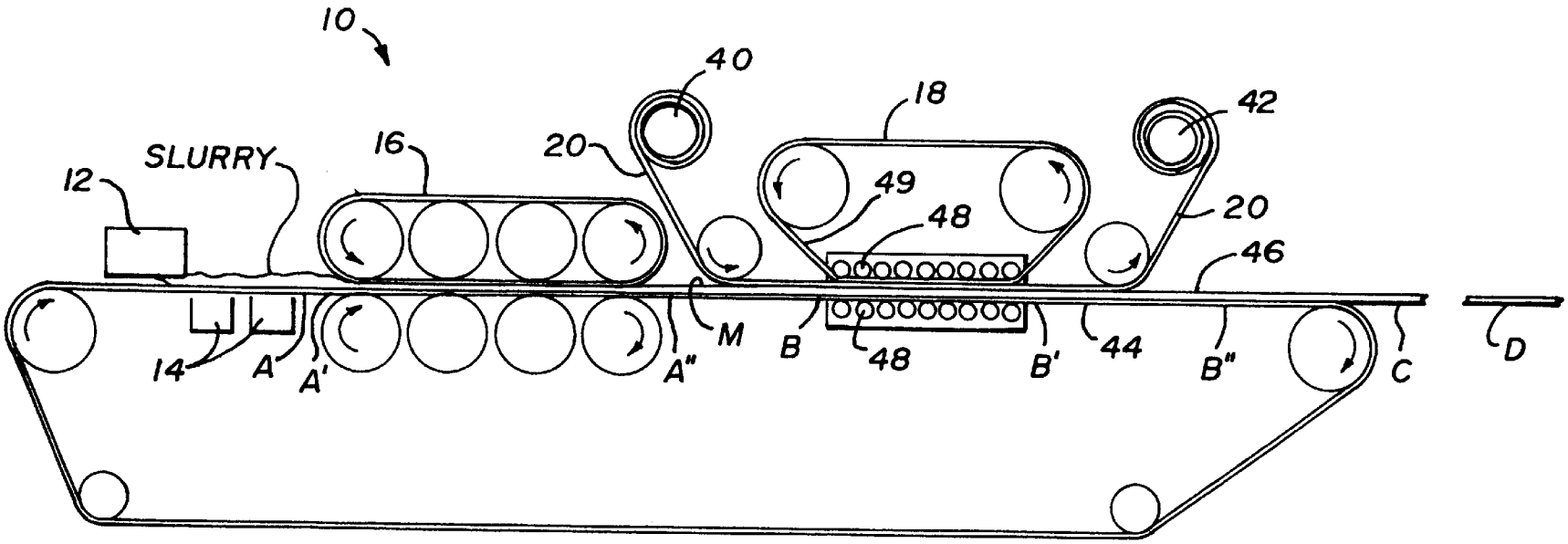
FIG. 5 is a schematic view illustrating a production line for forming gypsum fiberboard having a head box, dewatering vacuum, a dewatering primary press, infeed and outfeed assemblies for a texturing die in combination with a secondary press, arranged for processing a rehydratable gypsum fiber slurry upon a conveyor; and, FIG. 6 is a hydration temperature over time trace curve having a generic or model profile that reflects the processing stages along the production line of FIG. 5 from when the calcined slurry begins rehydration on the conveyor through rehydration; and, FIG. 6A is a model graph of the range of approximate percentages of rehydration (set) reached at stages along the production line of FIG. 5.

In FIG. 4 a worker is shown peeling back the set urethane 30, which can then be rolled up for use in the inventive process, schematically illustrated in FIG. 5 (not drawn to scale). In the disclosed embodiment, the length of the resulting die 20 is variable. It also can be made to be a continuous belt for use on the secondary press 18 by joining its ends, as by a vulcanizing or other joining process.

The length of the die 20 is set by the length of the boards intended to be cut from the set mat. For use as a discontinuous die, a single die might be sufficient for one length of board, or if longer board lengths are intended, multiples die segments could be joined to be sufficiently long to have a portion extending from an infeed roller assembly 40 through the secondary press 18 to an out-take roller assembly 42. The width is dependent upon the conveyor width and the board size to be made. In the preferred form, one continuous texturing die 20 extends across the conveyor 44 shown in FIG. 5. Typically, a gypsum fiberboard process would yield 8 feet wide by 16 feet long panels in a continuous process. For ease of handling, for an 8 feet width and 16 feet length, the texturing die 20 would have a length of at least about 16 feet from infeed assembly 40 through out-take assembly 42.

It is envisioned that the process 10 forms a setting mat 46 having a nominal depth of about ¼ inch to ¾ inch to satisfy normal building construction requirements. Accordingly, it is envisioned that the texturing T in FIGS. 2–4, S in FIGS. 4A and 4B, and E in FIG. 3A, would have a depth in the range of from about 0.025 to 0.050 inches to achieve an aesthetically pleasing finish. Texture S is typically shallower than a wood grain texture T. The depth of the wainscot coating W is dependent upon the ultimate flexural strength of the board to be produced and is also dependent on the accelerators and additives used in a particular system. The wainscot W may be typically formed up to about one-half the thickness of the resulting mat 46.

Use of Flexible Die in Manufacture of Gypsum Fiberboard Panels

The method of using lightweight flexible dies is particularly useful with a continuous process of setting material, such as said fiberboard process 10 shown in FIG. 5, and described in said U.S. Pat. No. 5,320,677. The urethane dies 20 can be easily hand fed through a continuous press 18 having sufficient pressure to compress or deform fine textures into the mat just after setting begins and then removed after a suitable amount of set has occurred, but before reaching the maximum exothermic reaction temperature along the hydration curve.

Pressure against the main top belt 49 of the secondary press 18 should be sufficient to drive the urethane die 20 and rollers 48 of the secondary press 18. Rolls of die 20 may be unrolled by hand, with the textured side against the top of the mat M as it enters the secondary press 18. As schematically shown in FIG. 5, the urethane die 20 contacts the mat M at the infeed to the secondary press 18 where the mat is still unset and pliable. Hydration has just begun before the mat enters the secondary press 18. The mat M with an impressed texture or surface relief then begins setting while under the pressure of the urethane die 20. The die 20 separates from the formed panel 46 emerging from the secondary press 18 whereat the panel 46 has set to a somewhat stiffened condition, yet below maximum set. The set is to the point where moderate pressure by one's index finger would not leave an indentation.

The die 20 can then be easily rolled up at out-take assembly 42 and re-fed into the inlet of the secondary press 18 at infeed assembly 40. Alternately, the ends of the die 20 can be joined, such as by vulcanizing, to form an endless belt that is placed around the secondary press 18 and revolves therearound to continuously press against the mat M. A plurality of dies 20 may also be joined for longer board lengths.

In making a wainscot W surface relief type of panel, an increased pressure on the edge results in a densified and strengthened edge, making for less damage in handling and also during installation, as well as offering excellent fastener holding properties. Similarly, when providing a die 20 shaped to create edge tapers E in FIG. 3A, the board edges at E are densified and yield enhanced fastening strength. The edge tapers E are typically provided to allow for joint compound and taping at panel joints. The set composite 46 would be separated along the centerline, and the edges trimmed off, so that both boards $B_1$ and $B_2$ would be provided with edge tapers E.

Figure 4A:
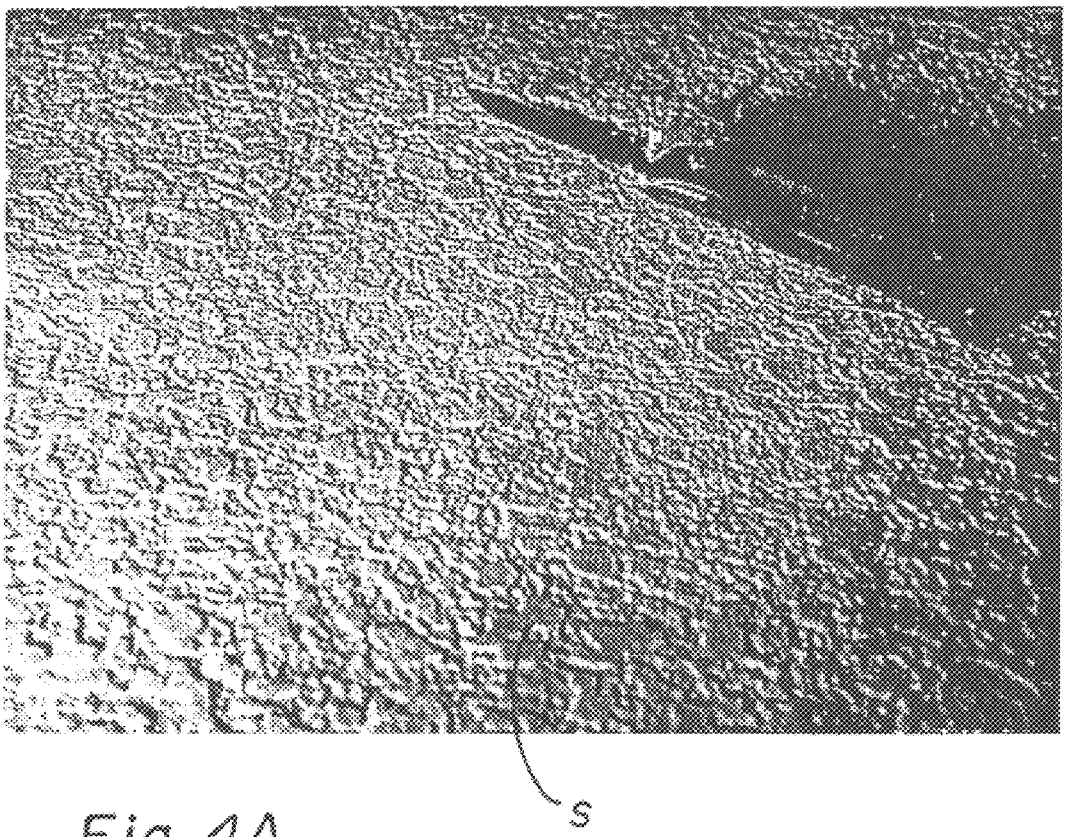
FIG. 4A is a plan view of a panel having a type of texturing known as spatter knock-down that is producible by the invention.
Figure 4B:
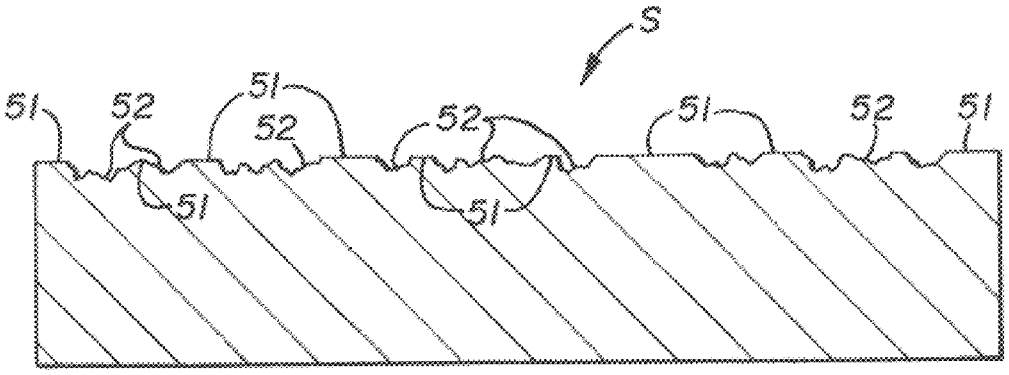
FIG. 4B is a cross-section of the panel of FIG. 4A showing the texturing features.

In FIGS. 4A and 4B, a die 20 is formed to have the negative image of the spatter knockdown style texturing S. This shallow textured look has flattened peaks, or lands, 51 above surrounding textured valleys 52 creating a desired esthetically pleasing appearance for interior construction.

Figure 6:
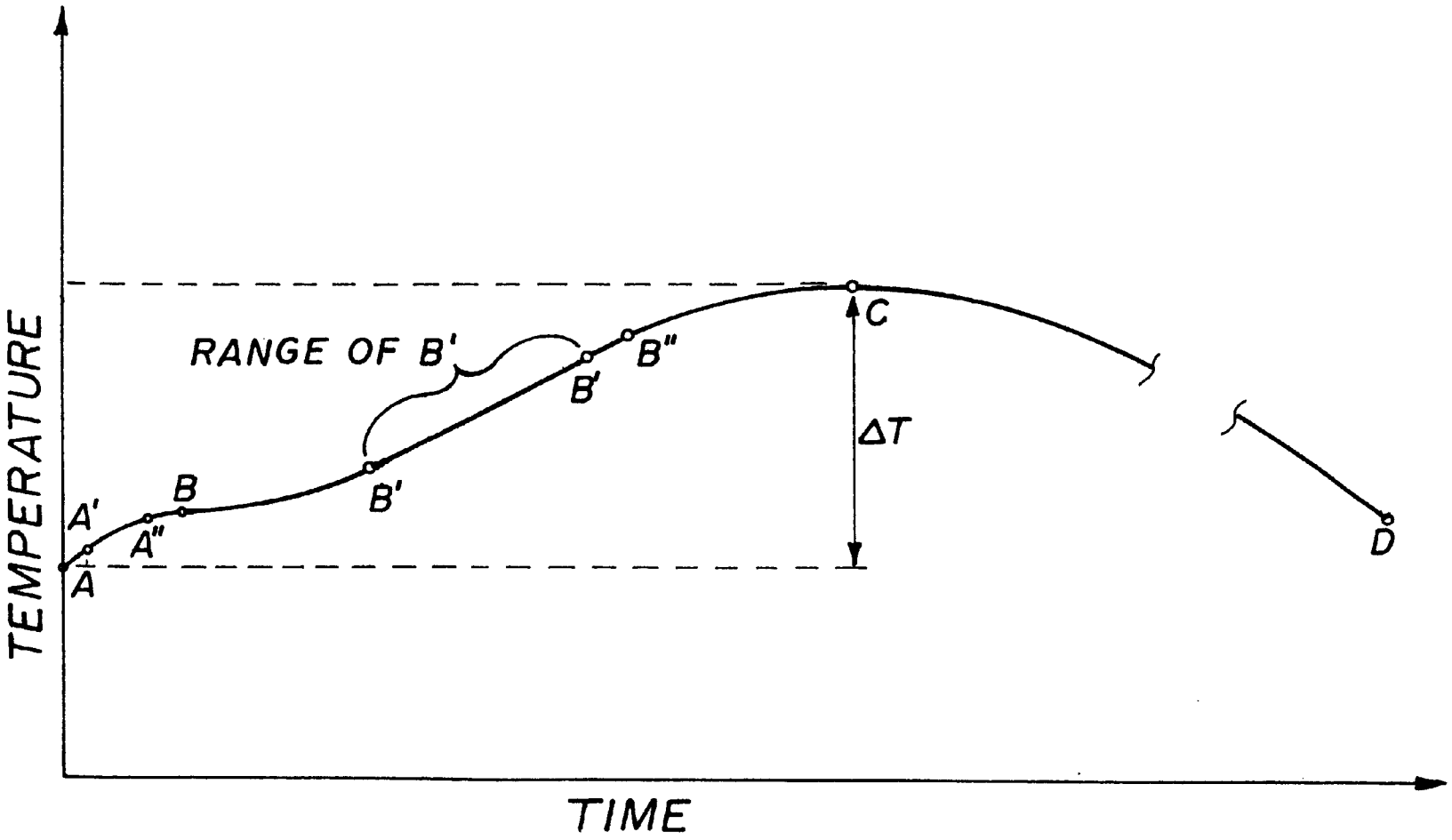

FIG. 6 is a model hydration trace curve for setting gypsum fiberboard. The curve's shape would also be understood by those in the industry as representative of the temperature curve that rehydrating calcined gypsum undergoes when it is mixed with water and dropped in temperature to the rehydration level after leaving a calcining kettle. Certain points along this hydration curve are critical to the invention with respect to how the hydration curve melds with corresponding processing points or steps on the production line process, i.e. from (a) leaving the head box 12 onto conveyor 44, *b*) dewatering by vacuuming boxes 14, *c*) passing through a first press 16, *d*) moving through a distance along the conveyor 44 and then *e*) passing through the secondary press 18 for a certain duration, whereupon the mat 46 leaves the secondary press 18 at a desired point along the hydration curve of FIG. 6.

Figure 6A:
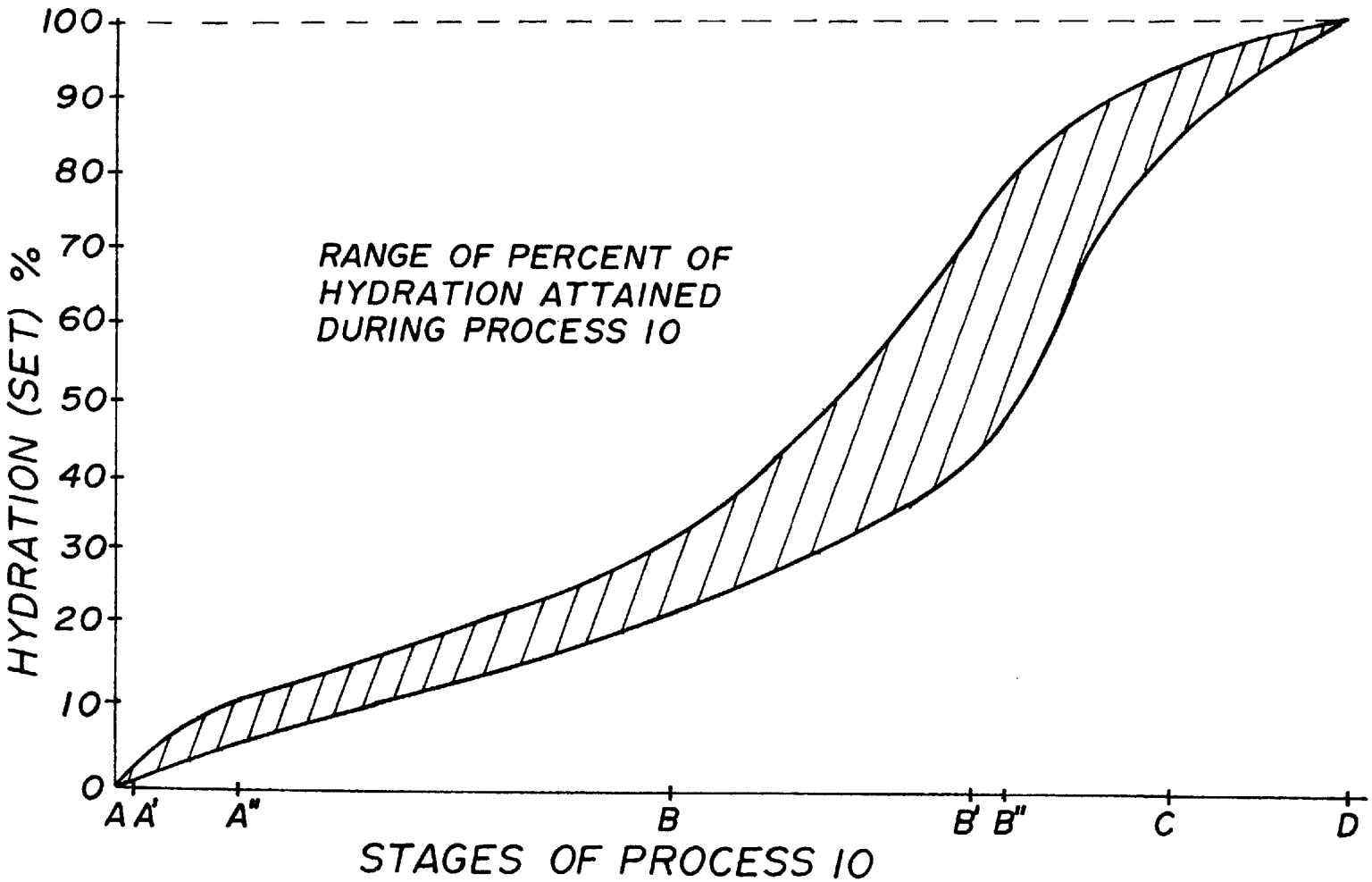

FIG. 6A is a plot of the ranges of estimated setting at certain points corresponding to the points labeled in FIG. 6 and showing the percentage range of maximum hydration (setting) at each point. The Y axis is the percentage of hydration reached and the X axis is the position of the mat as it moves through process 10.

In FIG. 6 it will be seen that the Y axis is temperature and the X axis is time. The temperature curve reflects a starting point A at zero time at about the point after the slurry is fed onto the conveyor 44 from the head box and has been dewatered by vacuum boxes 14 to drop to the rehydration temperature, which is typically from about 60° F. to about 120° F. The temperature having dropped from the higher calcining temperature in the calcining kettle (not shown) when fed to the head box 12, which could be about 200° F. or more when first poured onto the conveyor 44. Point A is the rehydration temperature. Point A' is the point shortly thereafter when the mat M enters primary press 16, whereat hydration has begun. The primary (wet) press 16 removes about 80–90% of any remaining free water by use of alternating suction and plain rolls. The mat M leaves the press 16 at point A" where the exothermic hydration reaction has reached about 5–10% of the maximum temperature rise. It has been learned that the start point B for successfully creating surface impressions is after a slight amount of hydration and setting occur, and continuing for only part of the hydration period thereafter. This time period has been found to be the time sufficient for the temperature to reach a value B' shown as a range in FIG. 6. Point C is the highest temperature reached by the exothermic reaction. The mat M enters the secondary press 16 at point B where the temperature has reached about 15–25% of the rise from A to C ($\Delta T$). The mat M leaves the secondary press 18 at point B' where the temperature has risen to about 25–60% of the rise from A to C ($\Delta T$). In the secondary press 18, the gypsum fiberboard sets and expands. The secondary press 18 and the die 20 carried thereon nips down the mat M. The expansion pressure of the rehydrating gypsum causes the mat to fill the die texturing W, T, E or S.

When ending contact between the die 20 and the mat 46 at point B', there will have been sufficient setting to retain the texturing detail. Therefore keys to the present method require a) the mat M to enter into contact with the die 20 while soft, *b*) the expansion of the setting mat under die pressing for a period of time to reach sufficient setting and *c*) then leaving the die at point B' falling in said range shown in FIG. 6 along the temperature curve with the relief maintainable thereafter. The control of the temperature of the exothermic process can be slowed down or speeded up by the use of additives, retardants, and other catalysts, as known in the prior art methods for rehydrating calcium sulfate hemihydrate. It is of course necessary to drop the temperature of the slurry with minimal free water remaining, so that rehydration does not occur in the presence of excess water.

In regard to the temperature curve of FIG. 6, the X axis could alternately be distance along the conveyor 44 instead of time. The shape of the curve over distance would be generally the same configuration, wherein there is a drop of the temperature leaving the head box to a point where rehydration begins at point A, with the curve then rising to a point B and then to a point B', which is a point along a portion of the curve that has a generally linear constant slope up to a point B". It is along this constant slope line that the exothermic reaction quickly accelerates and where the texturing pressure from the die 20 occurs for up to about 25–60% of the climb to the maximum temperature point C. After point B' is reached, the reactions slows and the linear plot changes to an advancing curve before reaching the maximum exothermic temperature C. It is expected that with a hydration starting level A at about 60°–120° F. the highest temperature C would be from about 70°–140° F. These temperatures are highly influenced by, among other things, ambient conditions in a board plant and the presence of metal structure heat sinks along the conveyor line. Then after point C, the temperature plot curves downwardly as the composite approaches full rehydration at point D.

Points A, A', B, B', B", C and D have been placed on FIG. 5 denoting the corresponding locations in this schematic illustration of the process 10. FIG. 5 is not drawn to scale.

FIG. 6A plots the percentage of full set (rehydration) on the Y axis at the corresponding locations on the X axis for points A, A', B, B', B", C and D of FIGS. 5 and 6. At point A', the mat M enters the primary press 16 at no more than about 5% rehydration. It exits at about 5–10% rehydration. At entry to the secondary press 18, the mat M has been found to have reached about a 20–30% set. Upon leaving the secondary press 18 at point B', a person cannot leave a fingerprint using moderate pressure and the hydration is estimated to be about 40–70% completed. At the highest temperature C generated from the heat given off by the exothermic reaction, hydration has empirically been found to be about 80–90% completed. The board is then usually cut into panel widths and lengths, and reaches a final set at point D. Drying in an oven or at ambient conditions then follows.

The temperature rise during hydration and the time or distance over which the rise takes place is dependent upon various calcining factors, such as, among others, the gypsum and fiber ratios, the amount of water present, and of course the amounts of the additives, accelerators, retardants and catalysts which may be changed to increase or decrease setting time.

The invention is not limited to a urethane compound for making a die, and other equivalent tough, flexible compounds may be used.

Various features of the invention have been particularly shown and described in connection with the illustrated embodiments of the invention. However, it must be understood that these particular products, and their method of manufacture, do not limit but merely illustrate, and that the invention is to be given its fullest interpretation within the terms of the appended claims.

What is claimed is:

1. A method for making textured gypsum fiberboard comprising the steps of:

mixing ground gypsum and host particles of a fibrous reinforcement material and sufficient liquid to make a dilute slurry consisting of at least about 70% liquid by weight;

calcining said gypsum, in the presence of said host particles, by heating said dilute slurry under pressure, to form acicular calcium sulfate alpha hemihydrate crystals;

separating a major portion of said liquid from said calcined gypsum and host particles to form a filter cake;

reducing the temperature of the filter cake to the rehydration temperature of said calcined gypsum to begin setting;

firstly pressing said filter cake to form aboard and to remove additional water therefrom;

providing a flexible die having texture at one side thereof, and secondly pressing said texture of said flexible die against said board while said board is setting and pliable;

allowing said board to continue setting while under the pressure of said flexible die;

separating said board from said flexible die when the temperature of said board is no greater than about 60% of the temperature rise between the rehydration temperature and the highest temperature reached during rehydration; and drying said board to remove any remaining free water.

2. The method in accordance with claim 1 wherein said step of providing a flexible die further includes preparing a flexible urethane die from a master panel having texture.

3. A method for making a textured gypsum and fiber composite material comprising the steps of:

making a urethane die from a master surface;

curing said urethane die;

removing said urethane die from said master surface;

applying the textured surface of said urethane die to a rehydrating gypsum and fiber composite material while said composite material is still in a setting state;

allowing said gypsum and fiber composite material to continue setting, thereby causing said textured surface of said urethane die to create a textured surface on said gypsum and fiber composite material; and removing said urethane die from said composite material when the temperature of said composite material is no greater than about 60% of the temperature rise between the rehydration temperature and the highest temperature reached during rehydration.

4. A method of making a textured product, comprising the steps of:

calcining gypsum to form acicular crystalline calcium sulfate hemihydrate in the presence of wood fibers to form a slurry;

dewatering said slurry to remove a majority of water content and form a filter cake mat;

reducing the temperature of the mat to the rehydration temperature of the calcined gypsum;

pressing said filter cake mat to remove additional water;

re-pressing said filter cake mat by imposing a flexible textured die onto the filter cake mat while the mat is setting and pliable;

allowing the mat to partially set during the re-pressing step;

removing the mat from contact with said textured flexible die when the mat has reached from about 40% to 70% of final setting; and, continuing the setting of said mat until fully set having the negative of said textured die thereon.

5. The method of claim 4 wherein the re-pressing step comprises re-pressing with a textured flexible die made of urethane.

6. The method of claim 5 wherein the re-pressing step comprises re-pressing with a textured flexible die comprising a layer of urethane.

7. The method of claim 5 wherein the re-pressing step comprises re-pressing with a textured flexible die comprising an endless belt of urethane.

8. A method for making textured gypsum fiberboard comprising the steps of:

mixing ground gypsum and host particles of a fibrous reinforcement material and sufficient liquid to make a dilute slurry consisting of at least about 70% liquid by weight;

calcining said gypsum, in the presence of said host particles, by heating under pressure and forming calcium sulfate hemihydrate;

separating a major portion of said liquid from said calcined gypsum and host particles to form a filter cake;

reducing the filter cake temperature to the rehydration temperature of the calcium sulfate hemihydrate;

firstly pressing said filter cake to form a board and to remove additional water therefrom;

providing a die having texture;

secondly pressing said texture of said die against said board while said board is setting and pliable; and separating said board from said die at a point in rehydration wherein said board temperature is no greater than about 60% the temperature rise between the rehydration temperature and the highest temperature reached during rehydration.

9. The method in accordance with claim 8 wherein said step of separating occurs when the board temperature is in the range of from about 25%–60% of the temperature rise between the rehydration temperature and said highest temperature.

10. A method for making textured gypsum and fiber composite material comprising the steps of:

delivering a urethane onto a master surface having relief;

curing said urethane;

removing said urethane from said master surface and forming a flexible die having surface relief;

applying the surface relief of said urethane die to a rehydrating calcined gypsum and fiber composite material while said composite material is setting and pliable;

allowing said gypsum and fiber composite material to continue rehydrating and setting, causing said relief surface of said urethane die to form a relief surface on said gypsum and fibre composite material; and removing said urethane die from said composite material at a temperature of said composite material no greater than about 60% of the temperature increase between the rehydration temperature and the maximum temperature reached during rehydration.

11. A method of making a textured board, comprising the steps of:

calcining gypsum to form calcium sulfate hemihydrate in the presence of wood fibers and water to form a slurry;

dewatering said slurry to remove a majority of free water content and form a filter cake mat;

reducing said filter cake temperature to the rehydration temperature of the calcium sulfate hemihydrate;

pressing said filter cake mat to remove additional water and form a board;

re-pressing said board by imposing a textured die onto the board while the board is pliable and rehydration is occurring;

allowing the board to partially set during the re-pressing step; and, removing the board from contact with said textured die at a temperature of no greater than about 60% between the temperature at the start of rehydration and highest rehydration temperature.

12. The method of claim 11 wherein the re-pressing step comprises re-pressing using a textured die being a layer of material.

13. The method of claim 11 wherein the re-pressing step comprises re-pressing using a textured flexible die being an endless belt.

14. The method of claim 11 wherein the re-pressing step comprises re-pressing using a textured flexible die comprising urethane.

15. The method of claim 11 wherein the re-pressing step begins after the filter cake mat reaches from about 10% to about 25% of the increase between the rehydration temperature and highest rehydration temperature.

16. The method of claim 11 wherein the removing step takes place along the exothermic reaction temperature rise curve of the rehydrating material at a point of from about 25% to about 60% of the temperature rise from the start of rehydration to the highest point of the exothermic reaction temperature curve.

17. The method of claim 16 wherein the temperature rise curve has a substantially constant slope portion and said removing step occurs at a point therealong.

18. The method of claim 11 wherein the step of removing the board from contact with the textured die occurs when the board is from about 40% to about 70% fully rehydrated.

19. The method of claim 18 wherein the board is sufficiently set whereby moderate pressure from a person's finger leaves no impression for removal of the board from contact with the die.

* * * * *